US010344548B2

(12) United States Patent
Ruttley et al.

(10) Patent No.: US 10,344,548 B2
(45) Date of Patent: Jul. 9, 2019

(54) WELL BORE CASING CUTTING TOOL HAVING AN IMPROVED BLADE STRUCTURE AND PAD TYPE STABILIZERS

(71) Applicant: Deltide Energy Services, LLC, Harvey, LA (US)

(72) Inventors: David J. Ruttley, Marrero, LA (US); Charles L. Bryant, Harvey, LA (US)

(73) Assignee: ABRADO, INC., Houston, TX (US)

( * ) Notice: Subject to any disclaimer, the term of this patent is extended or adjusted under 35 U.S.C. 154(b) by 468 days.

(21) Appl. No.: 14/904,896

(22) PCT Filed: Jul. 15, 2014

(86) PCT No.: PCT/US2014/046598

§ 371 (c)(1),
(2) Date: Jan. 13, 2016

(87) PCT Pub. No.: WO2015/009662

PCT Pub. Date: Jan. 22, 2015

(65) Prior Publication Data

US 2016/0138353 A1 May 19, 2016

Related U.S. Application Data

(60) Provisional application No. 61/846,211, filed on Jul. 15, 2013, provisional application No. 61/846,873, filed on Jul. 16, 2013.

(51) Int. Cl.
*E21B 29/00* (2006.01)
*E21B 17/10* (2006.01)

(52) U.S. Cl.
CPC ..... *E21B 29/005* (2013.01); *E21B 17/1078* (2013.01)

(58) Field of Classification Search
CPC ..... E21B 29/005; E21B 17/1078
USPC ..... 166/298
See application file for complete search history.

(56) References Cited

U.S. PATENT DOCUMENTS 4,776,394 A * 10/1988 Lynde ..... E21B 17/1021 166/55.8
5,853,054 A * 12/1998 McGarian ..... E21B 10/322 175/267
6,920,923 B1 * 7/2005 Pietrobelli ..... E21B 29/005 166/55.2
7,063,155 B2 6/2006 Ruttley

* cited by examiner

*Primary Examiner* — Matthew R Buck
*Assistant Examiner* — Patrick F Lambe
(74) *Attorney, Agent, or Firm* — Law Office of Jesse D. Lambert, LLC

(57) ABSTRACT

A downhole cutting tool for cutting sections or "windows" in tubular strings in wellbores has rotating cutters and a lower stabilizer section, both actuated by a fluid operated mechanism. The stabilizer section keeps the downhole cutting tool centralized in the tubular string. The cutters may have a robust profile and structure which enhances the window cutting function and permits passage of an operating rod to operate the stabilizer section.

6 Claims, 12 Drawing Sheets

WELL BORE CASING CUTTING TOOL HAVING AN IMPROVED BLADE STRUCTURE AND PAD TYPE STABILIZERS

CROSS REFERENCE TO RELATED APPLICATIONS

This regular patent application claims priority to U.S. provisional patent applications Ser. No. 61/846,211, filed Jul. 15, 2013, and Ser. No. 61/846,873, filed Jul. 16, 2013, for all purposes. The disclosures of those provisional patent applications are incorporated herein by reference to the extent required.

BACKGROUND

Various tools have been developed for downhole cutting or severing of casing strings in wellbores, and for cutting or milling window sections in casing strings. Generally, such tools have comprised a main body with multiple hinged arms or blades, which are rotated outwardly into contact with the casing (by hydraulic or other means) when the tool is in position downhole. U.S. Pat. No. 7,063,155 is an example of this type of downhole cutting tool. Usually, fluid is pumped down through the drillstring and through the tool to actuate the mechanism and rotate the blades outward. Once the blades are rotated outwardly, rotation of the drillstring (and tool) causes the cutting surfaces on the blades to cut through the casing string. Fluids are pumped through the system to lift the cuttings to the surface. Known tools, however, cannot efficiently cut or sever multiple, cemented-together casing strings, and in particular cannot efficiently cut "windows" in such strings; by the term "window" is meant the cutting or milling of a section (e.g. 20') of the casing string, as opposed to simply severing same.

In many tools, the blades comprise some form of hardened cutting material, e.g. carbide, to provide the actual cutting surface, such material being much harder than the casing being cut. However, known designs of cutters have various shortcomings in design.

BRIEF DESCRIPTION OF THE DRAWINGS

FIG. 7 is looking generally at the top surfaces of the blade, while FIG. 8 is looking generally at the lower surfaces of the blade.

FIG. 10 is looking generally at the top surfaces of the blade, while FIG. 11 is looking generally at the lower surfaces of the blade.

DESCRIPTION OF THE PRESENTLY PREFERRED EMBODIMENT(S)

Figure 1:
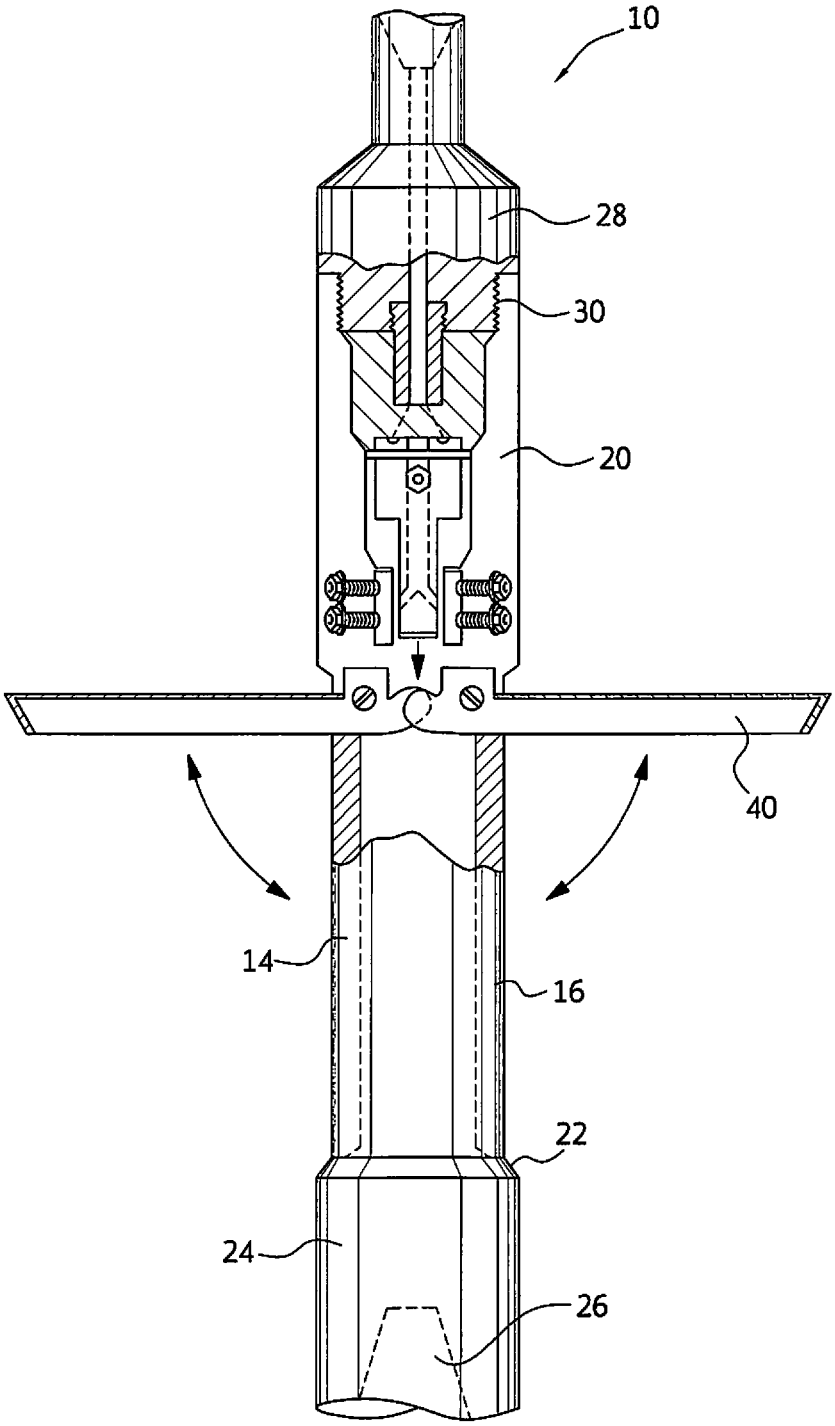
FIG. 1 PRIOR ART
FIG. 1 is a drawing of a rotating blade cutting tool, as seen in U.S. Pat. No. 7,063,155, owned by the owner of the present invention, showing generally the operating mechanism of an exemplary cutting tool, with which which the pad stabilizers and the blade design of the present invention may be used.

While a number of embodiments are possible, within the scope of the invention, with reference to the drawings some of the presently preferred embodiments can be described.

It is to be understood that the apparatus of the present invention is referred to generally herein as a "cutting tool." That term is given its broadest meaning consistent with use in the relevant art, and includes tools deployed into a wellbore on a tubular string that are used to sever casing strings and/or cut or mill sections thereof, often referred to as "windows."

Pad Type Stabilizing Mechanism

With reference to the drawings, the cutting tool 10 comprises a main body 20, typically having threaded connections at both ends 22 and 24 for threadably connecting to a tubular string, such as a drillstring. As is well known in the art, casing mill 10 is run downhole into a tubular or casing string on a drillstring. Main body 20 has a bore 26 which runs through main body 20.

Figure 2:
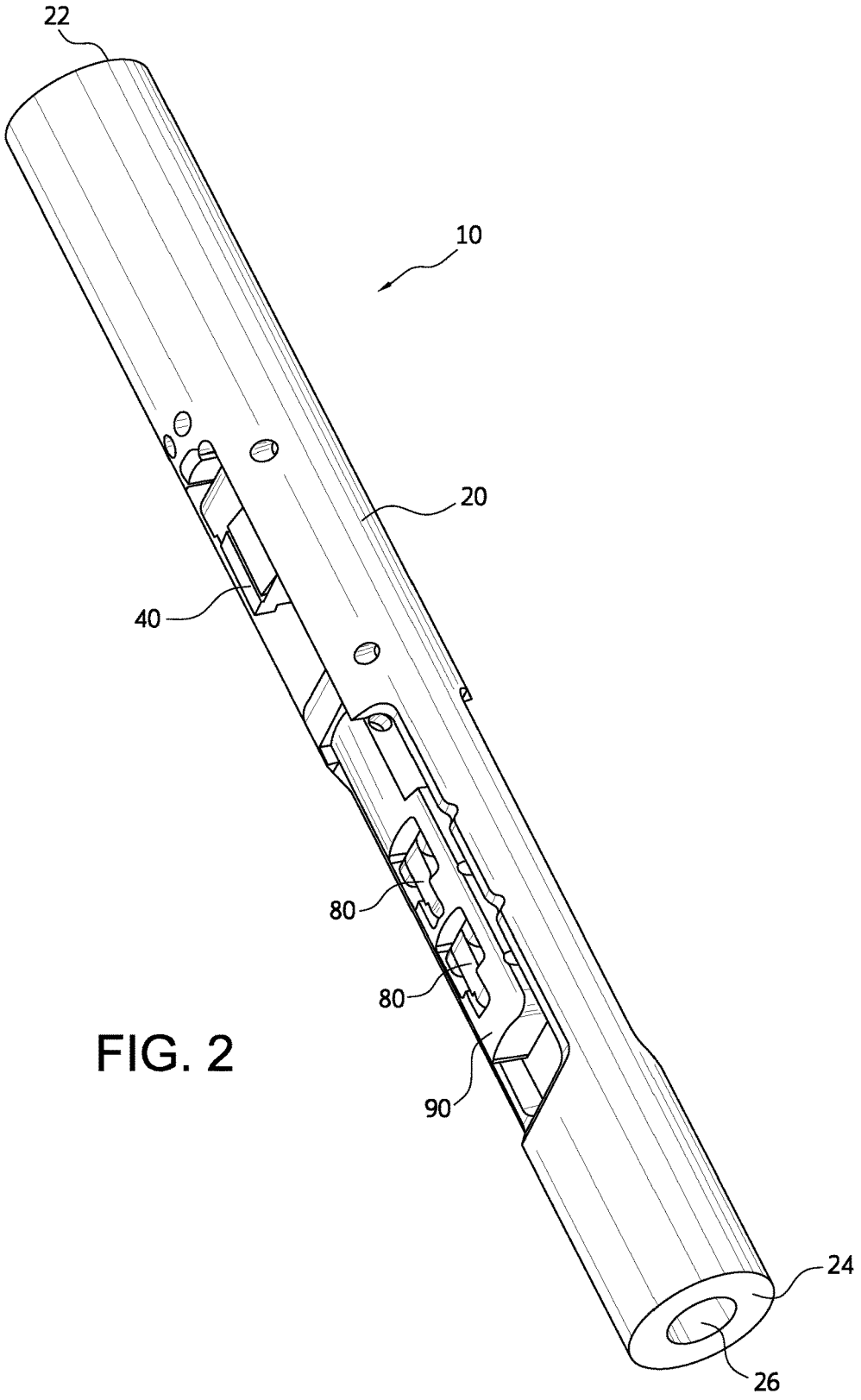
FIG. 2 is a perspective view of an exemplary cutting tool embodying the principles of the present invention, with the blades and stabilizer pads in a first, retracted position.
Figure 3:
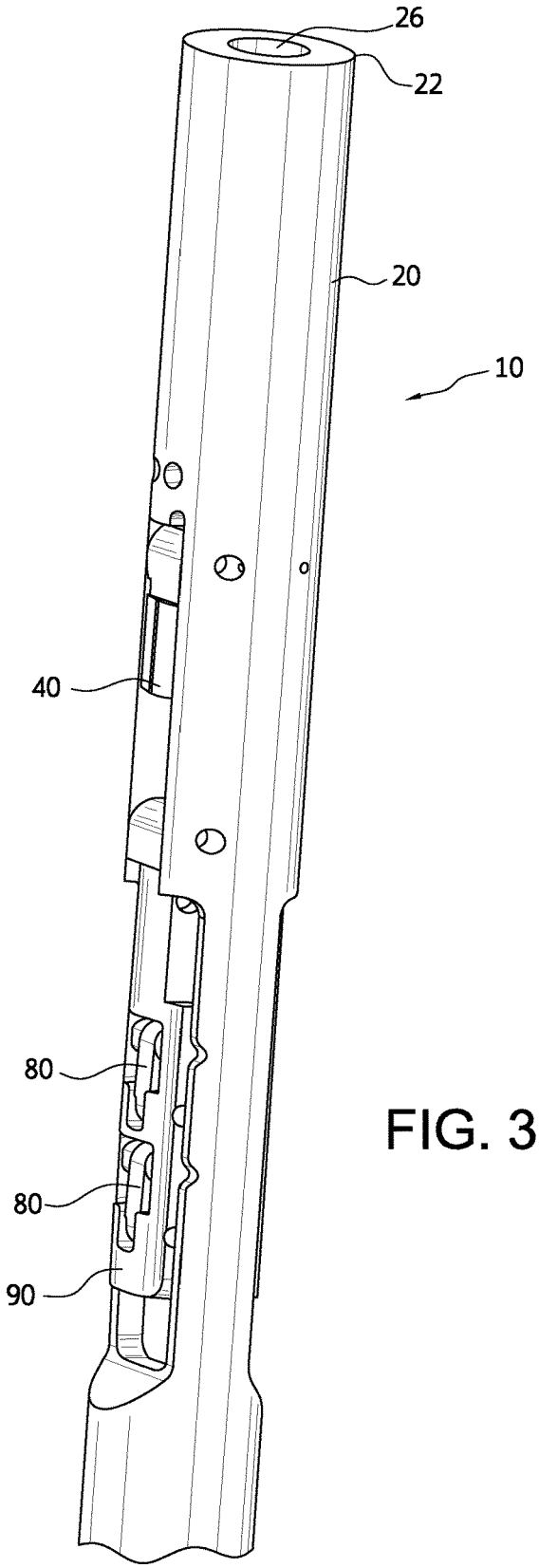
FIG. 3 is another perspective view of the exemplary tool of FIG. 2, with the blades and stabilizer pads in a first, retracted position
Figure 4:
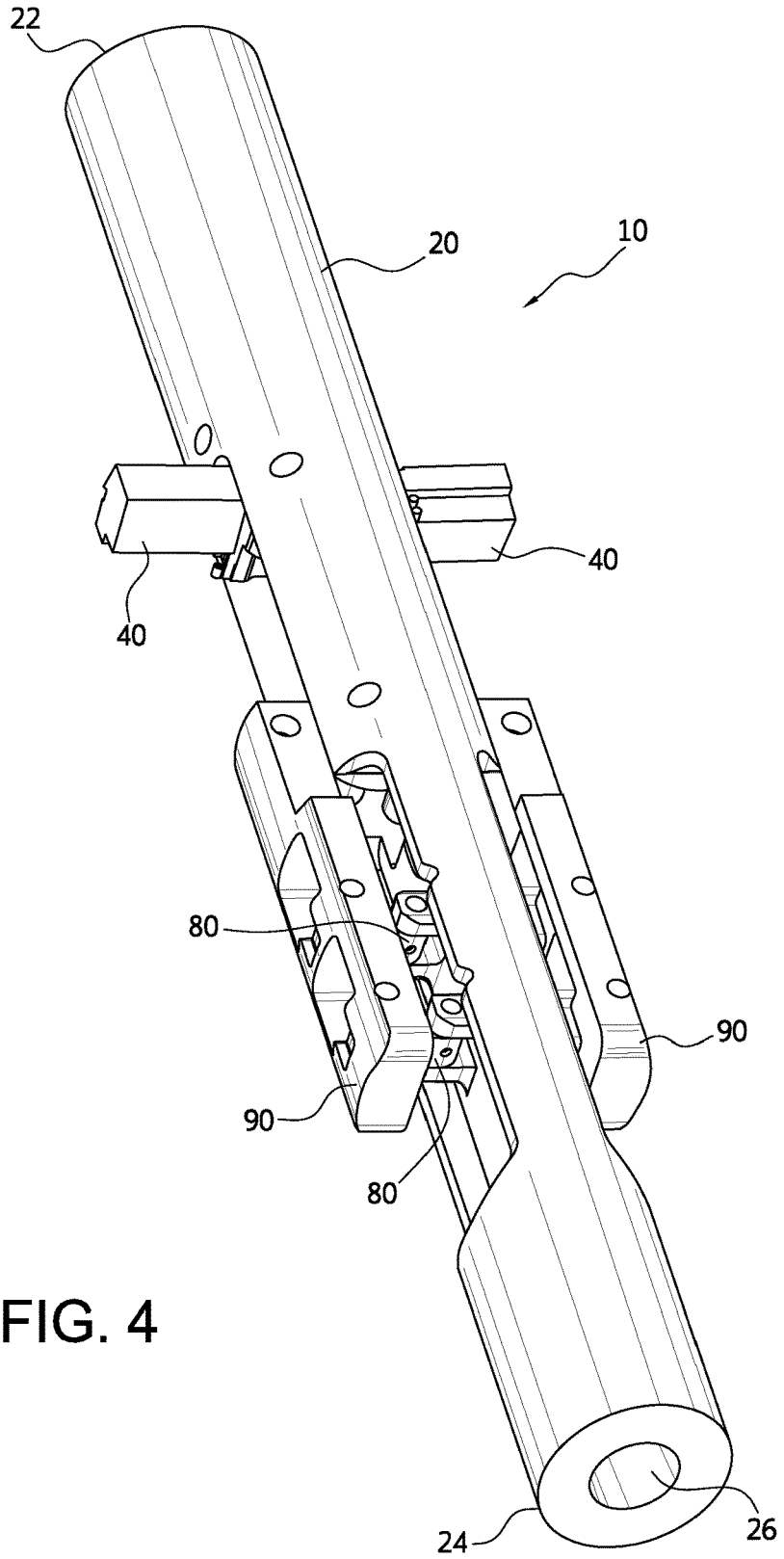
FIG. 4 is a perspective view of the exemplary tool of FIG. 2, with the blades and stabilizer pads in a second, extended position.
Figure 5:
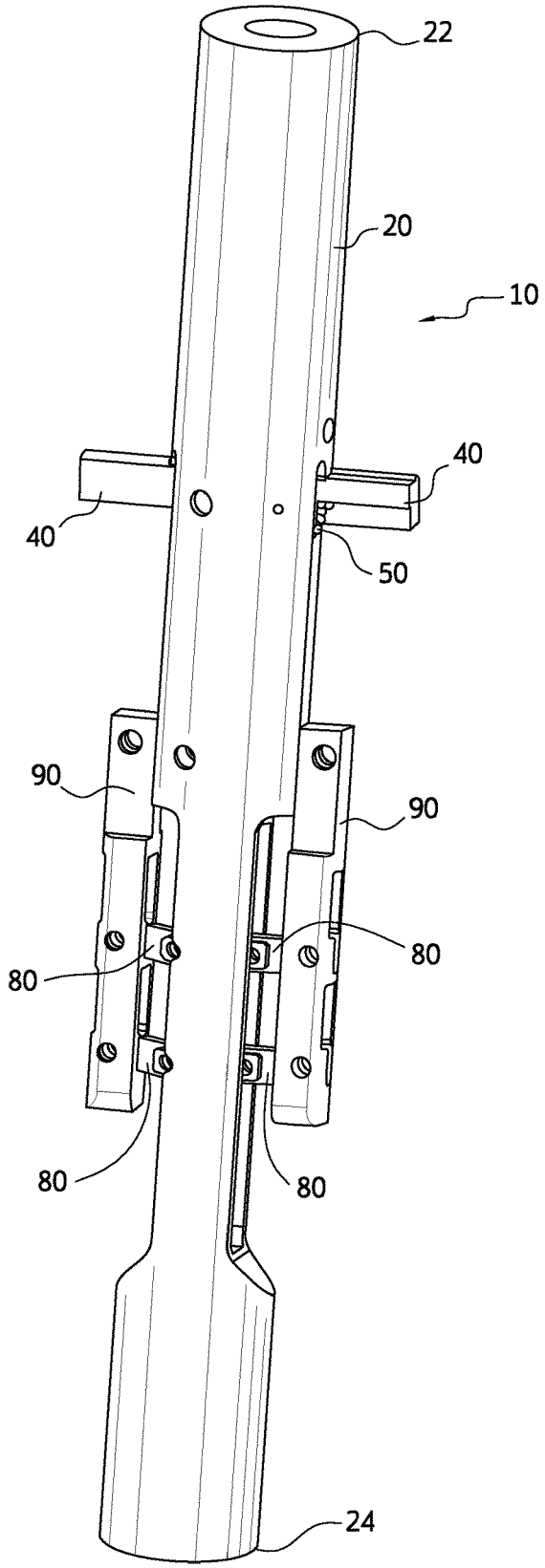
FIG. 5 is another perspective view of the exemplary tool of FIG. 2, with the blades and stabilizer pads in a second, extended position as in FIG. 4.

One or more, usually two, blades 40 are rotatably attached to main body 20 by pins or other means known in the art. Blades 40 can therefore move between a first, retracted position as shown in FIGS. 2 and 3, and a second, extended position as shown in FIGS. 4 and 5. An internal operating mechanism 60 (shown in FIG. 5, and with some attributes shown in FIG. 1), comprising a piston 62 disposed in bore 26 of main body 20, is pushed in a downhole direction by fluid flow through the drillstring. The piston bears on a heel portion 42 of blades 40, pushing the heel portions down and forcing blades 40 to rotate to the second, open position. FIG. 5 shows various aspects of the operating mechanism 60. A suitable operating mechanism is that shown in U.S. Pat. No. 7,063,155, see FIG. 1, owned by the Applicant of this application, the disclosure of which is incorporated herein to the extent necessary to disclose the internal operating mechanism. Note that the operating mechanism also actuates positioning arms 80 to move stabilizer pads 90 into position, as described in more detail below.

Blades 40 can take any form suitable for cutting and/or milling casing. Dimensions of blades 40 are as required to cut/mill desired casing strings, and if desired some amount of cement and/or formation. Cutters 50 (FIGS. 5 and 6) are mounted on blades 40, and may take the form of hardened carbide buttons or other suitable cutter forms known in the art. In particular, one embodiment of the present invention beneficially uses the blade and cutter configuration described later herein.

Attached to main body 20 by a plurality of linkage or positioning arms 80 are stabilizer pads 90. In the embodiment shown in the drawings, casing cutting tool 10 has two stabilizer pads 90, but other numbers are possible within the scope of the invention. Positioning arms 80 are substantially of equal length, so it is understood that when stabilizer pads 90 are in an extended position as in FIGS. 4-6, stabilizer pads 90 are substantially parallel to the longitudinal axis of main body 20. Positioning arms 80 are hingedly attached to both main body 20 and to stabilizer pads 90. It is to be understood that the invention encompasses different numbers of positioning arms; generally, a minimum of two arms per stabilizer pad are required (one actuated arm and at least one additional arm), but a greater number may be used depending upon the particular tool dimensions.

Figure 6:
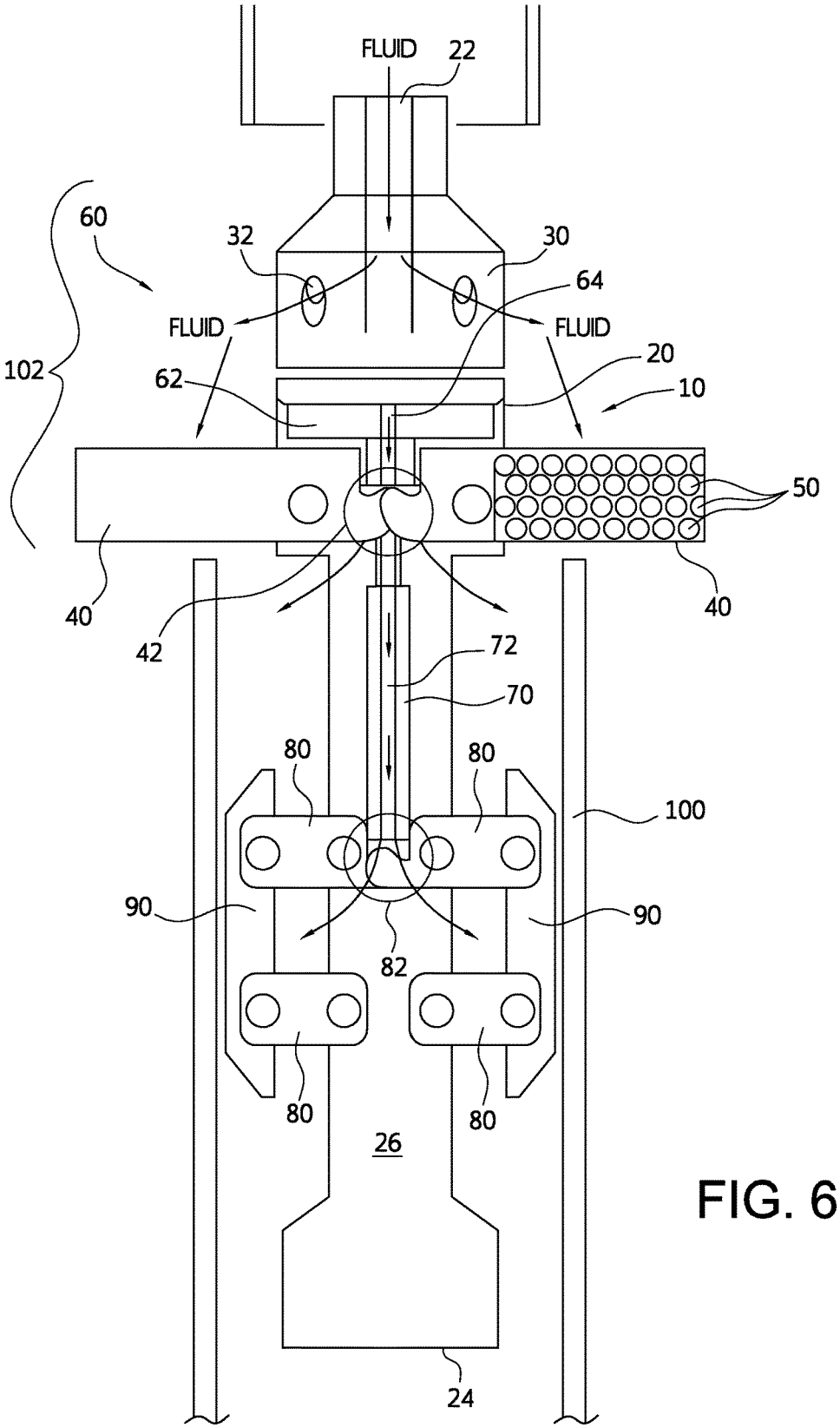
FIG. 6 is a side view in partial cross section of an exemplary tool embodying the principles of the present invention, generally conforming to that of the preceding drawings, with the blades and stabilizer pads in a second, extended position and the tool in position in a casing string.

Different mechanisms can be used to move stabilizer pads 90 from a first, retracted position, generally within main body 20 and not protruding significantly therefrom, as shown in FIGS. 2 and 3; to a second, extended position, wherein stabilizer pads 90 (along with blades 40) are partially or fully extended from the body, as seen in FIGS. 4-6. While not confining the current invention to any particular operating mechanism, as previously noted one suitable mechanism is that disclosed in U.S. Pat. No. 7,063,155, owned by the assignee of this invention, the relevant attributes of which are shown in FIG. 1. Referring to FIG. 6, generally, suitable operating mechanisms employ a piston 62 disposed in the bore of main body 20. As described above in connection with operation of the blades, piston 62 itself has a bore 64 of smaller diameter than the bore in which it is disposed; therefore, fluid pumped down the bore of main body 20 flows in part through the bore of the piston, and forces the piston downward. Piston 62 pushes on heel portions 42 of blades 40 and rotates them outwardly to their open position. An operating rod extension 70 is operatively connected to piston 62, such that operating rod extension 70 is also pushed down when piston 62 is pushed down. Operating rod extension 70 pushes on a heel portion 82 of the uppermost positioning arms 80, causing them to rotate. It is understood that only one of positioning arms 80 on each stabilizer pad need be actuated; generally the uppermost of positioning arms 80 is actuated. Operating rod extension 70 has a longitudinal bore 72 therethrough, so that a portion of overall fluid flow flows through the length of operating rod extension 70 and out its lowermost end. This fluid flow path is shown in FIG. 6.

When fluid is pumped down the tubular string on which cutting tool 10 is run, fluid flows into and through bore 26 of main body 20. A portion of the fluid flow exits ports 32 in jetted top sub 30, which is disposed above (in an uphole direction from) blades 40. This portion of the total fluid flow (as can be seen in FIG. 6) is directed so as to strike blades 40, keeping them relatively clean, and to circulate back uphole, bringing cuttings up in the flow. Another portion of the overall fluid flow flows through flow passages in main body 20, and between heel portions 42 of blades 40, thence out into the annulus, as shown in FIG. 6.

FIG. 6 shows cutting tool 10 in an operating position. A section of casing 100 is shown in which a window section 102 has already been milled. Stabilizer pads 90 are fully extended, bearing against or near the inner wall of casing string 100 so as to center cutting tool 100 within casing string 100. It is understood that, as well known in the art, FIG. 6 shows cutting tool 10 in a downhole position, run downhole on a drillstring (not shown), and being rotated in a conventional, right hand direction. Fluid is also being pumped through the drillstring and through cutting tool 10, and circulated back uphole.

With fluid circulation ongoing, thereby extending stabilizer pads 90 and blades 40 to the position shown in FIG. 6, cutting tool 10 is lowered so that blades 40 and cutters 50 thereon engage the upper end of casing 100. The drillstring and cutting tool 10 are rotated while weight is applied to cutting tool 10, resulting in casing 100 being milled away. Milling continues as cutters 50 are gradually worn away, since as described above once a given row or set of cutters is sufficiently worn, the next set of cutters moves into cutting position and cutting continues.

Dimensions of blades 40 may be as desired to extend far enough out to cut or mill a desired casing string diameter. In addition, with proper dimensions, blades 40 and cutters 50 can be designed and configured to cut/mill not only a single casing string, but also multiple casing strings and cement and formation surrounding the casing string(s).

Method of Use of the Casing Mill

An exemplary method of use of cutting tool 10 with stabilizer pads 90 can now be described. A main body 20, blades 40, positioning arms 80, and stabilizer pads 90, are selected with dimensions appropriate for the size casing that is to be cut, and for any additional cement/formation to be removed. A relatively short downhole window is first cut in the tubular in interest, with the tool of the present invention, or with a two-arm casing cutter or conventional casing mill. A window of sufficient length that cutters 40 can rotate outward and fit therein is generally desired.

Referring to FIG. 6, the next step is to locate casing cutting tool 10 within the window. Although various methods are possible, one preferred method is to lower cutting tool 10 to a depth known to be within the window. Fluid circulation is then started, which will move blades 40, positioning arms 80 and stabilizer pads 90 outward. Stabilizer pads 90 will come into or nearly into contact with the casing wall. Cutting tool 10 is then lowered to bring blades 40 and cutters 50 into contact with the upper edge of casing string 100; this is the position seen in FIG. 6. Fluid circulation continues so as to maintain the proper positioning of the blades and stabilizer pads. Rotation of the cutting tool 10 is commenced, and a desired amount of weight is applied to the casing mill, to force the lowermost cutter edge against the casing edge and consequently commence cutting or milling of the casing. Fluid flow maintains the tool in its open position and circulates metal/cement/formation cuttings to the surface. It is to be understood that the sequence of steps set forth above is only one possible method of use; same may be changed as required, including but not limited to the sequence or order of the different operations, additional steps may be added, steps may be omitted, etc.

Once the desired length of window has been cut, fluid flow is stopped, the blades and stabilizer pads retract into the tool main body, and the tool can be retrieved from the well.

Improved Cutters of the Present Invention

As can be readily understood, blades 40 may beneficially employ particular cutter designs.

Figure 7:
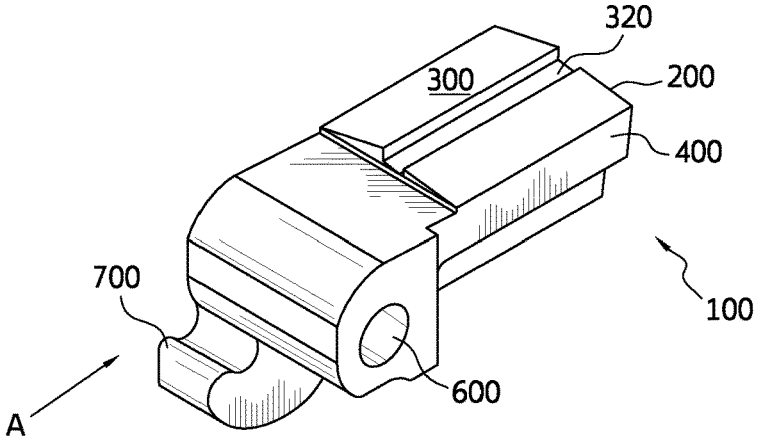
FIGS. 7 and 8 are perspective views of a blade embodying the principles of the present invention, viewed generally from a position at the rear or heel of the blade.
Figure 8:
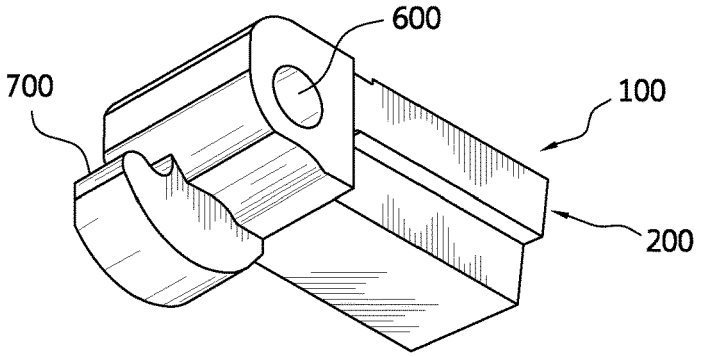
Figure 9:
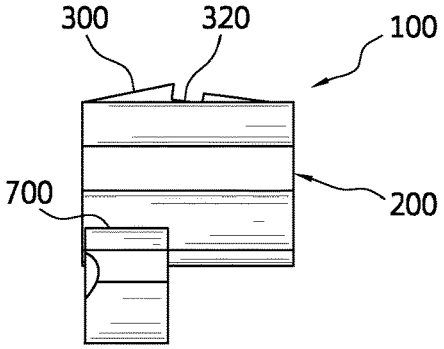
FIG. 9 is an end-on view of the blade in FIGS. 7 and 8, viewed in the direction of arrow A in FIG. 7, which is from the rear or heel end of the blade.
Figure 10:
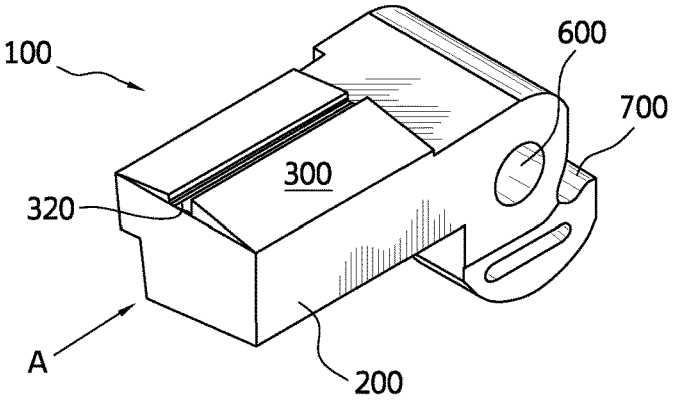
FIGS. 10 and 11 are perspective views of the blade in FIGS. 7-9, viewed generally from a position at the front end of the blade (generally the opposite end from FIGS. 7 and 8).
Figure 11:
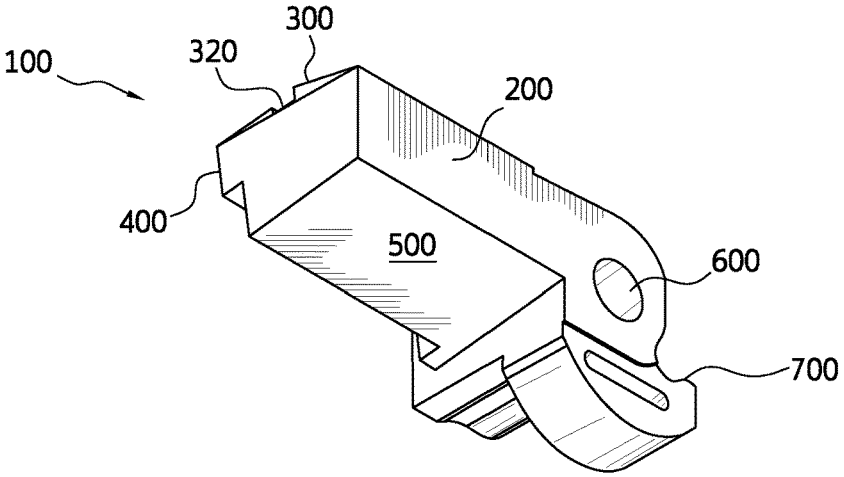
Figure 12:
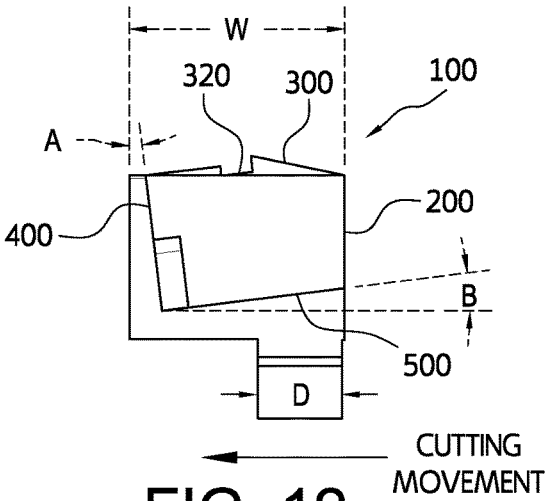
FIG. 12 is an end-on view of the blade in FIGS. 10 and 11, viewed in the direction of arrow A in FIG. 10, which is from the front end of the blade.
Figure 13:
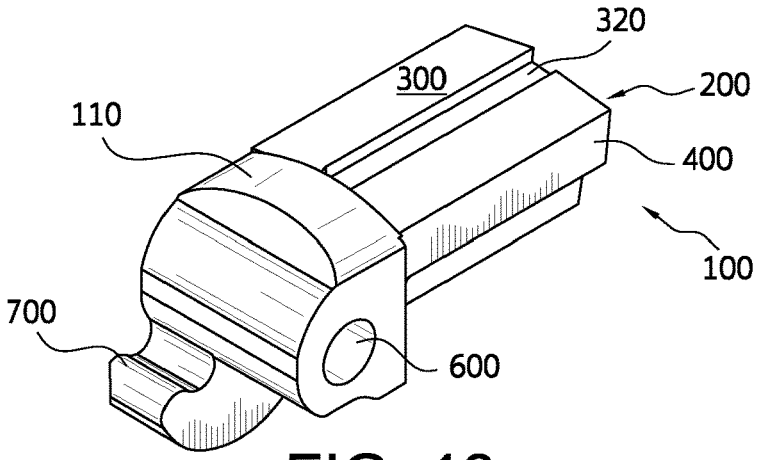
FIGS. 13-18 are views generally corresponding to FIGS. 7-12, of another embodiment of the blade of the present invention.
Figure 14:
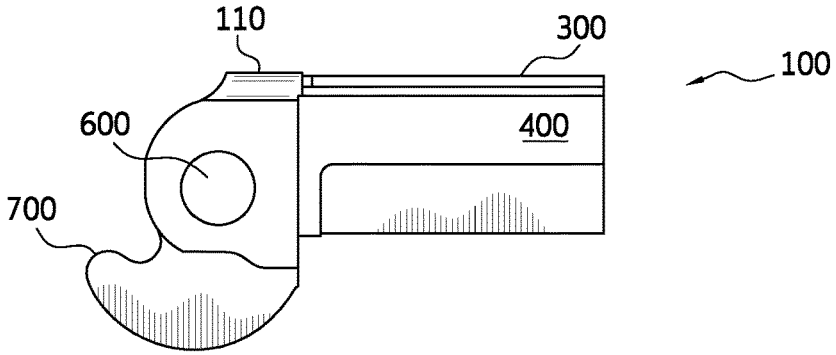
Figure 15:
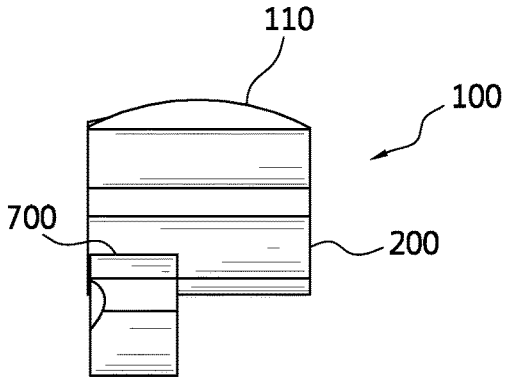
Figure 16:
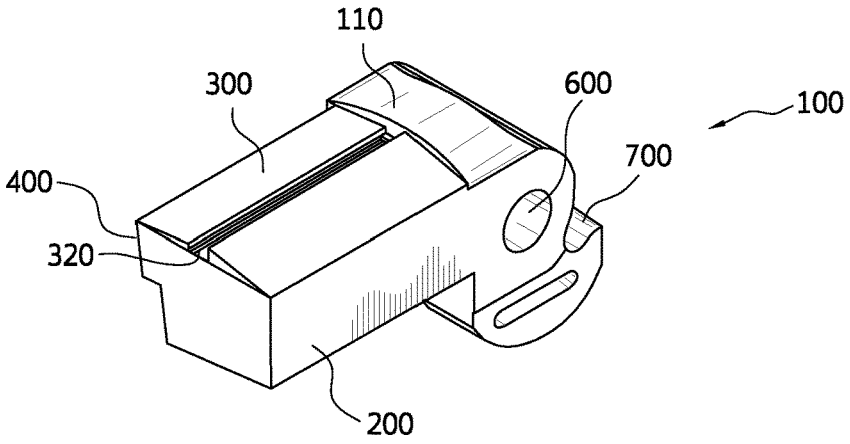
Figure 17:
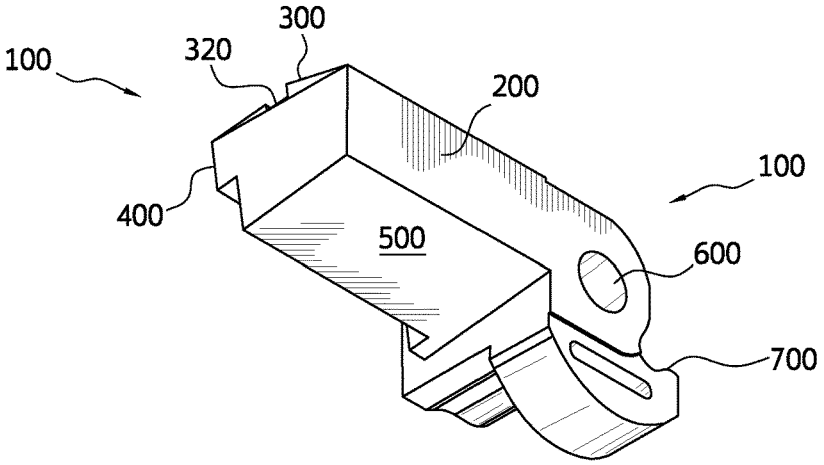
Figure 18:
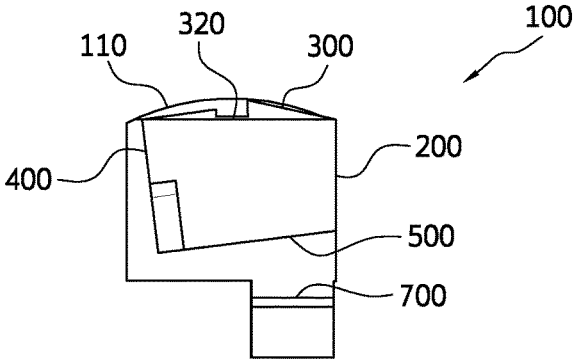

Referring to FIGS. 5-12: FIGS. 7 and 8 are perspective views of the blade of the present invention. FIG. 9 is an end-on view of the blade, looking from the rear or heel end of the blade, in the direction indicated by arrow A in FIG. 7. FIG. 12 is an end-on view of the blade, looking from the front end of the blade (a direction opposite to the view of FIG. 9, and in the direction of arrow A in FIG. 10). Blade 100 has a main body 200 with several structural attributes, as follows:

A generally rounded or domed top surface 300, which conforms generally to the radius of the main body of cutting tool CT, when the blades are in a first, retracted position. This design attribute, as compared to a prior art blade with a squared-off top surface, permits additional material to be present in the blade, without extending beyond the surface of main body 20 of the cutting tool when the blades are retracted.

The top surface 300 has a groove 320 running part or all of the length of blade 100, into which cutters may be affixed As can be best seen in FIG. 12, a leading cutting surface 400 which is inclined at an angle to the direction of cutting movement (as denoted by the arrow in FIG. 12), the inclination as shown in that the upper edge of the leading cutting surface 400 leads the bottom edge of that surface 400 in the direction of cutting movement. While various degrees of inclination could be used, a presently preferred value "A" is approximately 7 degrees of inclination.

As can be best seen in FIG. 12, a bottom cutting surface 500 which is inclined at an angle to the horizontal (as the blade is positioned in FIG. 12), the inclination as shown in that the trailing edge of the bottom cutting surface 500 is higher than the leading edge of that surface 500 in the direction of cutting movement. While various degrees of inclination could be used, a presently preferred value "B" is approximately 7 degrees of inclination.

Figure 20:
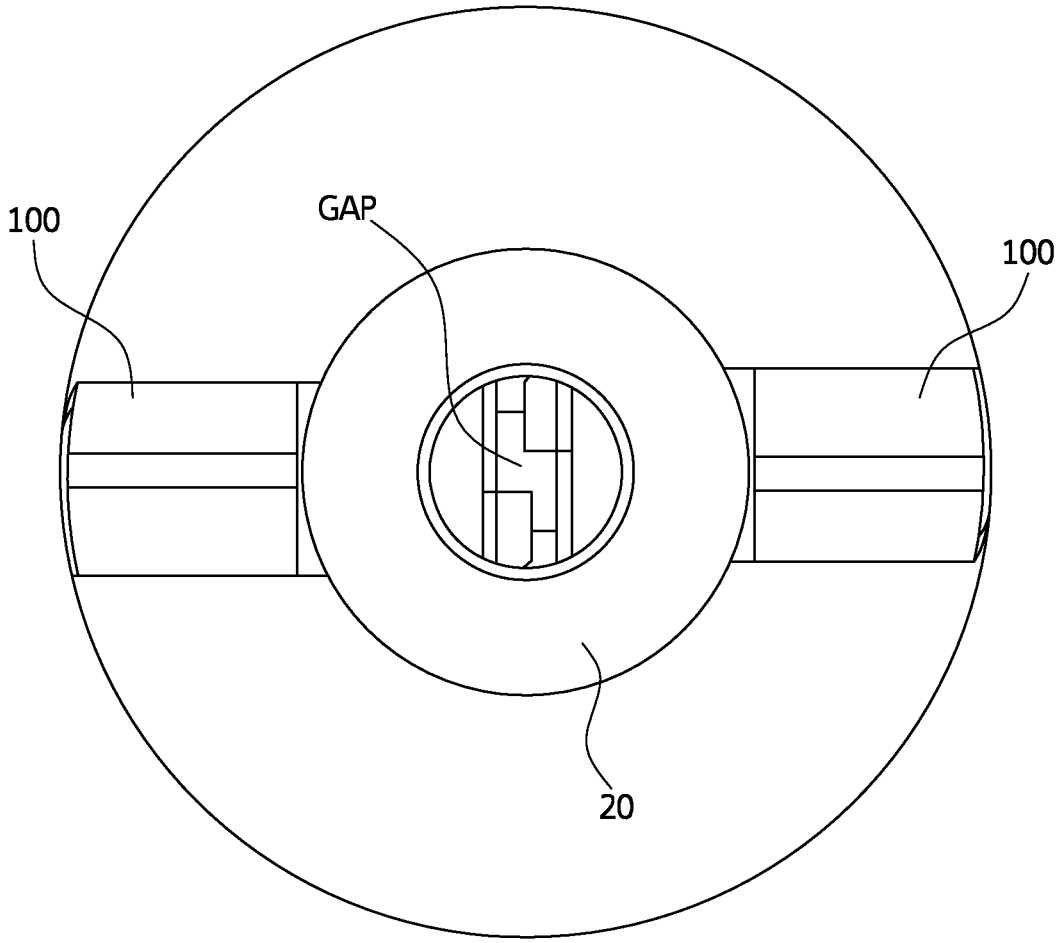
FIG. 20 is a view down the longitude of a cutting tool having cutter blades of the present invention mounted thereon.

Blade 100 has a hole 600 through which a pin is inserted, which is the means for rotatably fixing blade 100 within main body 20. Blade 100 has a heel portion 700, positioned on the far side of hole 600, which is pushed on by a piston within main body 20, to rotate blade 100 outwardly. This operating function is described in more detail in U.S. Pat. No. 7,063,155, which is incorporated herein by reference to the extent necessary to describe this function, and is further described in the foregoing description in connection with FIGS. 1-6 herein. As best seen in FIGS. 9 and 12, and as annotated in FIG. 12, heel portion 700 has a dimension D which is less than ½ of the full width W of blade 100. As can be understood, when a pair of blades 100 are rotatably mounted in main body 20, a gap or opening is thus created. This gap permits fluid flow to permit circulation for pumping/jetting, and permits passage of a mechanical element such as a flow tube to carry fluid flow below the blades, for example to a circulating extension, see FIG. 6. The gap also permits passage of a mechanical element such as an operating rod to actuate mechanisms positioned below the cutting tool, e.g. a stabilizer, see also FIG. 6. FIG. 20 shows this gap, as indicated.

FIGS. 13-18 show an embodiment of the cutter having a modified profile shape in side and end views. FIGS. 13-18 correspond generally to the views of FIGS. 7-12. As seen in those figures, blades 100 have a rounded profile section 110, proximal heel portion 700, referred to as the wrist section 110, which provides additional material to withstand stress placed on blade 100.

Figure 19:
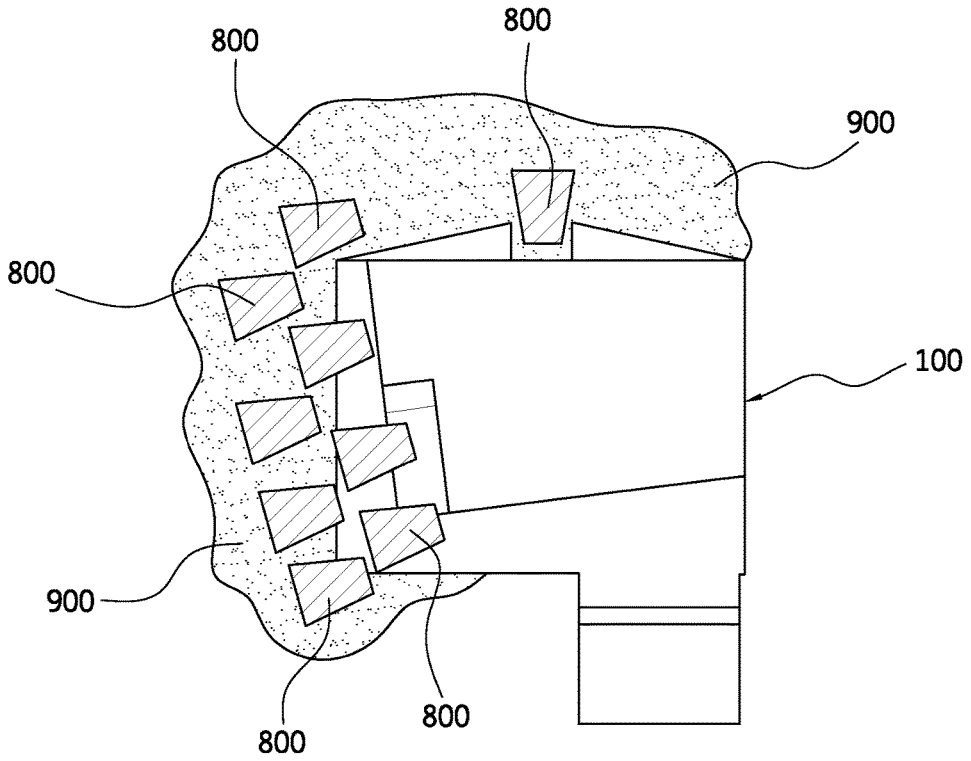
FIG. 19 is a cross section view showing an exemplary arrangement of cutters mounted on a blade, and of the additional hardened cutting surface thereton.

FIG. 19, which is an end view in cross section (similar to the view in FIG. 12), shows one presently preferred embodiment of the cutter arrangement as mounted on blade 100. One or more, preferably multiple, layers of cutters 800 are mounted on blade 100, by means well known in the art (welding, brazing, etc.). A hardened cutting material (described further below) effectively forms a matrix within which cutters 800 are secured. Cutters 800 may take various forms, such as hardened carbide "buttons," polycrystalline diamond compact disks, etc. Cutters 800 may individually have different face shapes, such as circular, or various polygonal shapes such as octagon, etc. As cutting and/or milling proceeds, cutters 800 and the matrix which fixes them on blade 100 are worn down until a layer of cutters 800 is fully used up, when cutting is assumed by the next underlying layer of cutters 800.

FIG. 19 also illustrates an attribute of one presently preferred embodiment of the present invention, namely a layer of hardened cutting material 900, for example carbide, on top of the one or more layers of cutters 800. The additional layer of hardened cutting material 900, namely a volume/thickness greater than that necessary to mount cutters 800 on blade 100, provides significant cutting capability before it is worn through, and cutting of the casing is assumed by cutters 800.

Materials

Blades 100 may be formed of high strength steel alloys, as known in the relevant field, by machining, forging, casting, etc. or some combination thereof. Dimensions of blades 100 may be altered to suit particular applications, with the length, width, etc. varied as needed. As described above, cutters 800 may be of carbide or other materials known in the art suitable for cutting and milling of casing.

CONCLUSION

While the preceding description contains many specificities, it is to be understood that same are presented only to describe some of the presently preferred embodiments of the invention, and not by way of limitation. Changes can be made to various aspects of the invention, without departing from the scope thereof. For example:

as noted above, dimensions may be varied to suit particular applications certain aspects of the overall shape of blades 10 may be changed to streamline manufacturing, etc.

cutters may be mounted in two, three, or more layers on blade 10, and the cutters may be of various materials and individual shapes various angles of cutting surfaces may be used, greater or less than the 7 degree example illustrated and described the blades may be used in conjunction with a number of different downhole tools, for purposes of cutting/milling casing strings downhole.

Therefore, the scope of the invention is to be determined not by the illustrative examples set forth above, but by the appended claims, and their legal equivalents.

We claim:

1. A downhole cutting tool, comprising:

a) a main body having a bore therethrough, and a fluid piston disposed in said bore and longitudinally movable therein, said piston having a bore therethrough;

b) a plurality of rotatably mounted blades mounted in said main body, movable from a first position retracted into said main body and a second position rotated outwardly from said main body;

c) a plurality of pairs of positioning arms rotatably mounted in said main body, and movable from a first position retracted into said main body and a second position rotated outwardly from said main body; and d) a stabilizer pad mounted on each pair of positioning arms, whereby when said positioning arms are rotated outwardly said stabilizer pad is moved radially outward from said main body and held generally parallel to said main body;

wherein said fluid piston bears on said blades under the influence of fluid flow through said bore of said main body, thereby rotating said blades from said first position to said second position, and wherein said fluid piston further comprises an operating rod extension which bears on at least one of said pairs of positioning arms, thereby rotating said positioning arms from said first position to said second position and moving said stabilizer pads outwardly, said operating rod extension comprising a longitudinal bore therethrough, said longitudinal bore providing a fluid flow path for fluid flow to said positioning arms.

2. The downhole cutting tool of claim 1, wherein said rotating arms and said stabilizer pads are dimensioned to position said stabilizer pads closely against an inner diameter of a casing string within which said cutting tool is positioned.

3. The downhole cutting tool of claim 1, wherein said blades, when viewed end-on, from an end of said blades distal from one of said downhole cutting tools in which one of said blade is mounted:

comprise a main body having a rounded top surface conforming to the radius of said main body, when said blades are in said first position;

a leading cutting surface inclined at an angle to a longitudinal axis of said downhole cutting tool and in the direction of the cutting movement; and a bottom cutting surface having a leading edge and a trailing edge and inclined at an angle to a line perpendicular to a longitudinal axis of said downhole cutting tool, such that the trailing edge of said bottom cutting surface is higher than the leading edge of said bottom cutting surface.

4. The downhole cutting tool of claim 3, wherein said blades have a width, and further comprise a heel portion against which said operating rod extension bears, said heel portion having a dimension less than one-half of said width of said blade.

5. The downhole cutting tool of claim 3, wherein said blades comprise a plurality of cutters mounted thereon, said cutters arranged in layers and embedded in a matrix of hardened cutting material.

6. A method of milling casing with a downhole cutting tool, said casing comprising a window section removed therefrom in a downhole location, said casing presenting an upward facing casing edge, comprising the steps of:

a. providing a downhole cutting tool comprising a main body having a bore therethrough, and a fluid piston disposed in said bore and longitudinally movable therein, said piston having a bore therethrough;

a plurality of rotatably mounted blades mounted in said main body, movable from a first position retracted into said main body and a second position rotated outwardly from said main body;

a plurality of pairs of positioning arms rotatably mounted in said main body, and movable from a first position retracted into said main body and a second position rotated outwardly from said main body; and a stabilizer pad mounted on each pair of positioning arms, whereby when said positioning arms are rotated outwardly said stabilizer pad is moved radially outward from said main body and held generally parallel to said main body;

wherein said fluid piston bears on said blades under the influence of fluid flow through said bore of said main body, thereby rotating said blades from said first position to said second position, and wherein said fluid piston further comprises an operating rod extension which bears on at least one of said pairs of positioning arms, thereby rotating said positioning arms from said first position to said second position and moving said stabilizer pads outwardly, said operating rod extension comprising a longitudinal bore therethrough, said longitudinal bore providing a fluid flow path for fluid flow to said positioning arms;

b) positioning said downhole cutting tool within said window section, said downhole cutting tool lowered on a tubular string;

c) pumping fluid through said tubular string and said downhole cutting tool, thereby rotating said blades to said second position and moving said stabilizer pads into proximity with an inner diameter of said casing string;

d) rotating said downhole cutting tool and lowering said downhole cutting tool until said blades contact said casing edge;

e) applying a desired amount of weight to said downhole cutting tool, while continuing pumping fluid and rotating said downhole cutting tool, thereby milling said casing, until a desired length of casing has been removed.

* * * * *